United States Patent [19]

Eckles et al.

[11] 4,188,271

[45] Feb. 12, 1980

[54] ALKALINE ZINC ELECTROPLATING BATHS AND ADDITIVE COMPOSITIONS THEREFOR

[75] Inventors: William E. Eckles, Cleveland Heights; Wilfred J. Ferguson, Cleveland; William J. Willis, Stow, all of Ohio

[73] Assignee: Rohco, Inc., Cleveland, Ohio

[21] Appl. No.: 651,978

[22] Filed: Jan. 23, 1976

Related U.S. Application Data

[63] Continuation-in-part of Ser. No. 640,457, Dec. 15, 1975, abandoned.

[51] Int. Cl.[2] ..... C25D 3/22; C25D 3/24; C08G 12/26

[52] U.S. Cl. ..... 204/55 R; 204/55 Y; 528/398; 528/250; 528/252; 525/506

[58] Field of Search ..... 204/55 R, 55 Y, 43 R, 204/44, 114; 260/67.5, 67.6 R; 528/231, 250, 252

[56] References Cited

U.S. PATENT DOCUMENTS

| | | | |
|---|---|---|---|
| 3,803,008 | 4/1974 | Rosenberg et al. | 204/55 Y |
| 3,849,325 | 11/1974 | Kampe | 204/55 Y X |
| 3,915,815 | 10/1975 | Koch | 204/55 Y |

*Primary Examiner*—G. L. Kaplan

*Attorney, Agent, or Firm*—Maky, Renner, Otto & Boisselle

[57] ABSTRACT

A composition is described which provides an improvement in the electrodeposition of zinc from aqueous alkaline plating baths and particularly from alkaline plating baths containing little or no cyanide. The new composition comprises the reaction product of one or more piperazines, at least one additional nitrogen-containing compound selected from the group consisting of ammonia or aliphatic acyclic compounds containing at least one primary amine group, formaldehyde, and an epihalohydrin or a glycerol halohydrin or mixtures thereof. Aqueous, alkaline zinc plating baths containing the additive compositions of the invention deposit a bright zinc coating over a wide range of current densities.

15 Claims, No Drawings

ALKALINE ZINC ELECTROPLATING BATHS AND ADDITIVE COMPOSITIONS THEREFOR

CROSS REFERENCE TO RELATED APPLICATION

This application is a continuation-in-part of co-pending application Ser. No. 640,457, filed Dec. 15, 1975, now abandoned, and is assigned to the same assignee.

BACKGROUND OF THE INVENTION

This invention relates to improvements in the electrodeposition of zinc from aqueous alkaline plating baths, and preferably from aqueous alkaline plating baths containing little or no cyanide. More particularly, the improvement relates to a new composition which is particularly suitable as a brightener additive for aqueous alkaline zinc electrodepositing baths containing little or no cyanide.

Considerable attention has been directed to the development of zinc electroplating baths which will produce zinc deposits of improved quality. Research has been devoted to improving the overall brightness, the range of allowable current densities, and the ductility of the zinc coatings. Until recently, most of the successful aqueous alkaline zinc plating baths have contained substantial quantities of sodium cyanide and various brightener compositions to improve the brightness of the zinc deposits.

Within the last few years, efforts have been made to improve the environment by reducing the amount of pollutants discharged to the atmosphere and to streams and rivers. Water pollution from the rinse waters of plating operations has been of concern to electroplaters because the rinse waters from plating operations using baths containing cyanide are quite toxic. Methods have been devised to detoxify these rinse waters, but the efficiency of the methods and the costs of equipment and chemicals have made these methods uneconomical.

Some cyanide-free or substantially cyanide-free alkaline zinc plating baths have been developed and are apparently being utilized. For example, U.S. Pat. No. 3,824,158 describes an aqueous alkaline zinc electroplating bath containing an epihalohydrin quaternary salt of aminated polyepichlorohydrin, and the bath is described as being useful for producing bright lustrous electrodeposits of zinc without requiring any cyanide.

U.S. Pat. No. 3,869,358 describes an aqueous alkaline zinc electroplating bath which contains less than about two ounces per gallon of cyanide and which contains a water soluble reaction product of an amine with an epihalohydrin containing recurring tertiary and/or quaternary amine groups. U.S. Pat. No. 3,849,325 also relates to the deposition of a bright zinc coating from an alkaline zinc electroplating bath which contains little or no cyanide. The brightening agent which is incorporated into the bath is obtained by the reaction of a nitrogen-containing heterocyclic compound such as pyridine, pyrazine, quinoline and derivatives thereof, an acyclic amine having at least two functional groups, formaldehyde and an epihalohydrin or a glycerol halohydrin.

SUMMARY OF THE INVENTION

The present invention comprises a novel composition which is the reaction product prepared from a mixture of one or more piperazines, at least one additional nitrogen-containing compound selected from the group consisting of ammonia or aliphatic acyclic compounds containing at least one primary amine group, formaldehyde and an epihalohydrin or a glycerol halohydrin or mixtures thereof. These compositions are particularly effective as a brightening agent for aqueous alkaline zinc electroplating baths containing less than two ounces per gallon of cyanide. The baths containing this novel brightener deposit bright zinc coatings over a very wide range of current densities.

DESCRIPTION OF THE PREFERRED EMBODIMENTS

The compositions of this invention which are particularly useful as additive compositions for aqueous alkaline zinc electroplating baths are prepared by reacting a piperazine, at least one additional nitrogen-containing compound selected from the group consisting of ammonia or aliphatic acyclic amines containing at least one primary amine group, formaldehyde and an epihalohydrin or a glycerol halohydrin in water. These compositions have been found to be particularly effective for depositing bright zinc coatings from aqueous alkaline zinc plating baths containing little or no cyanide.

The piperazines which are particularly useful in the preparation of the compositions have the general formula

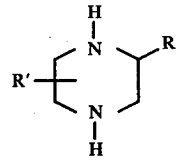

wherein R and R′ are each independently hydrogen or a lower alkyl group. Specific examples of these piperazines include piperazine, 2-methyl piperazine, and 2-ethyl piperazine. Salts of these piperazines such as the hydrochloride salts may be utilized.

The additional nitrogen-containing compounds which are utilized in the preparation of the compositions of this invention may be either ammonia or aliphatic acyclic compounds containing at least one primary amine group. Examples of the compounds contemplated as being useful include methyl amine, ethyl amine, and alkylene polyamines having the general formula $$H_2N\text{-}(\text{Alkylene NH})_x\text{ alkylene NH}_2$$

wherein x is an interger from 0 to 4 and the alkylene may be a straight or branched chain group containing up to about six carbon atoms. Examples of such alkylene polyamines include ethylene diamine, triethylene tetramine, propylene diamine, tripropylene tetramine, tetraethylene pentamine, trimethylene diamine and pentaethylene haxamine. Alkylene polyamines containing hydroxyalkyl substituents also are useful, and an example of such a compound is N-(2-hydroxyethyl) ethylene diamine. Combinations of the aliphatic acyclic compound may be utilized in the preparation of the compositions of the invention as well as combinations of ammonia with one or more of the aliphatic acyclic compounds.

Since the compositions of the invention generally are prepared in water, the formaldehyde is generally an aqueous solution such as, for example, an aqueous solution containing 37% formaldehyde which is commercially available as Formalin. Formaldehyde generators such as paraformaldehyde, trioxane, etc., may be utilized in the process as a source of formaldehyde.

The epihalohydrins that are useful in the preparation of the compositions of the invention include those having the formula

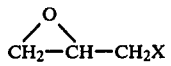

wherein X is chloro or bromo. Epichlorohydrin is particularly preferred. In lieu of or in addition to the epihalohydrins, glycerol halohydrins having the following formula may be utilized:

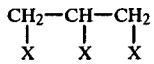

wherein at least one but not more than two of the X's are hydroxy groups and the remaining X's are chlorine or bromine. Examples of such reactants include, for example, 1,3-dichloro-2-hydroxypropane, 3-chloro-1,2-dihydroxypropane and 2,3-dichloro-1-hydroxypropane.

In preparing the compositions of this invention, the amounts of the piperazine and the additional nitrogen-containing compound or compounds utilized in the process generally are selected to provide a mole ratio of piperazine to additional nitrogen-containing compounds of about 1:1 although a ratio of from about 0.75:1 to about 1.5:0.5 may be utilized. The amount of formaldehyde incorporated into the mixture generally is based upon the amount of piperazine, ammonia and/or the number of primary amino groups present in the additional nitrogen-containing compounds. For example, it is preferred to react slightly in excess of: one mole of formaldehyde for each mole of the piperazine derivative; two moles of formaldehyde for each mole of ammonia; one mole of formaldehyde for each mole of alkyl monoamine such as methyl amine; and two moles of formaldehyde for each mole of alkylene diamine such as ethylene diamine. Therefore, the mole ratio of piperazine to additional nitrogen-containing compound to formaldehyde generally will be in the range of from about 1:1:2 to about 1:1:4.5. Additional formaldehyde does not appear to take part in the reaction and the characteristic odor of formaldehyde becomes evident.

The amount of epihalohydrin or glycerol halohydrin in the reaction mixture also may be varied. Preferably, the piperazine, additional nitrogen-containing compound in formaldehyde mixture is reacted with an amount of epihalohydrin or glycerol halohydrin to provide a molar ratio in the range of from about 1:1:2:1 to about 1:1:4.5:1. When higher amounts of epihalohydrin or glycerol halohydrin are utilized in the preparation of the composition, the product of the reaction has a tendency to produce stressed deposits of zinc which eventually blister.

The compositions of this invention preferably are prepared by dissolving the desired amounts of the piperazine and other nitrogen-containing compound in water contained in a reaction vessel equipped with a reflux condenser and stirrer. Formaldehyde or a formaldehyde generator is added to the solution and an exothermic reaction occurs. The epihalohydrin or glycerol halohydrin then is added dropwise to the mixture. The reaction may be conducted at any temperature between room temperature and the reflux temperature of the mixture. Obviously, shorter reaction times are required at the reflux temperature, and at this temperature, the reaction appears to be completed in about one-half to one hour. A brown solution of the product is obtained and can be utilized directly as a brightener additive for the zinc electroplating baths. It has been found that the stability and shelf life of the reaction product of this invention is enhanced if the pH of the solution obtained by the reaction described above is about 6.0. In those instances where the reaction product has a higher pH, the pH can be adjusted to about 6.0 with dilute sulfuric acid.

The following examples illustrate the preparation of compositions of this invention which are particularly useful as brightener additives in aqueous alkaline electroplating baths. Unless otherwise indicated, all parts and percentages are by weight.

EXAMPLE 1

To a reaction vessel containing 60 ml. of water and equipped with a heater, means for stirring and a water-jacketed condenser there is added 6.0 grams of ethylene diamine and 8.6 grams of piperazine. Thirty milliliters of a 37% aqueous formaldehyde solution is added slowly to the mixture. An exothermic reaction occurs resulting in an increase in the viscosity of the solution in the reactor. After stirring for about 30 minutes, 9.2 grams of epichlorohydrin is added slowly, and the mixture is heated to the reflux temperature and maintained at this temperature for about one hour. The resulting brown solution is allowed to cool to room temperature and the pH is adjusted to 6.0 with dilute sulfuric acid.

EXAMPLE 2

Piperazine (8.6 grams) and 5.86 grams of a 30% aqueous ammonia solution are added to 50 ml. of water contained in a reactor similar to that described in Example 1. Thirty milliliters of a 37% aqueous formaldehyde solution is added slowly to the mixture with stirring, and after about 30 minutes, 9.2 grams of epichlorohydrin are added dropwise with continued stirring. The mixture is then heated to the reflux temperature and maintained at this temperature for about one hour. The resulting brown solution is allowed to cool to room temperature.

EXAMPLE 3

Piperazine (8.6 grams) and 7.75 grams of a 40% aqueous solution of monomethyl amine are added to 50 ml. of water in a reactor similar to that described in Example 1. Twenty milliliters of a 37% aqueous formaldehyde solution is added slowly to the mixture with stirring, and after about 30 minutes of stirring, 9.2 grams of epichlorohydrin is added slowly. The mixture is then heated to the reflux temperature and maintained at this temperature for about one hour.

EXAMPLE 4

Ethylene diamine (6 grams) and 10 grams of 2-methyl piperazine are added to 70 ml. of water in a reactor similar to that described in Example 1. Thirty milliliters of a 37% aqueous formaldehyde solution are added slowly to the mixture with stirring, and after about 30 minutes of stirring, 9.2 grams of epichlorohydrin is added slowly. This mixture is heated to the reflux temperature and maintained at this temperature for about one hour.

EXAMPLE 5

Piperazine (8.6 grams) and 6 grams of ethylene diamine are added to 70 ml. of water in a reactor similar to that described in Example 1. Thirty milliliters of a 37% aqueous formaldehyde solution are added slowly to the reactor with stirring, and after about 30 minutes of stirring, 12.9 grams of 1,3-dichloro-2-hydroxypropane are added slowly with stirring. The mixture is heated to the reflux temperature and maintained at this temperature for one hour. The resulting brown solution is cooled to room temperature.

EXAMPLE 6

Guanidine hydrochloride (9.53 grams) and 8.6 grams of piperazine are dissolved in 60 milliliters of water in a reactor similar to that described in Example 1. Thirty milliliters of a 37% formaldehyde solution is then added dropwise with stirring. After 30 minutes of stirring, 9.2 grams of epichlorohydrin is added slowly, and this mixture is heated to the reflux temperature and maintained at this temperature for one hour. The resulting clear yellow solution is allowed to cool to room temperature.

As mentioned above, the compositions of the invention such as those described in Examples 1 through 6 are particularly useful as brightening additives for aqueous alkaline zinc plating baths which contain little or no cyanide. In general, the amount of the composition of this invention added to a plating bath will provide a concentration of the composition of from about 0.1 to about 2 or more grams per liter and preferably from about 0.25 to about 1.5 grams per liter.

The compositions of this invention may be added to any of the known aqueous alkaline zinc electrodepositing baths although the improvement in the brightness of the zinc deposit appears greater when the zinc plating bath contains less than two ounces per gallon of cyanide. The source of zinc ions in the aqueous alkaline baths can be an alkali metal zincate such as sodium zincate or potassium zincate. Other sources of zinc ions include zinc oxide, zinc sulfate, zinc acetate, etc. The low cyanide and non-cyanide alkaline baths also contain an alkaline material which is usually an alkali metal hydroxide such as sodium hydroxide or potassium hydroxide. The cyanide can be introduced into the bath as zinc cyanide or sodium cyanide.

The bright deposits obtained by the aqueous alkaline zinc plating baths containing the compositions of the invention can be improved by dissolving in the bath, conventional aldehyde brightening agents. Suitable aldehyde brighteners include veratraldehyde, anisic aldehyde, salicylic aldehyde, vanillin, piperonal, as well as other aromatic aldehydes and combinations thereof. These aldehyde brighteners generally are added to the electroplating bath as a bisulfite adduct. Other conventional brightening agents such as gelatin, peptone, 3-substituted-N-alkyl pyridium halides and quaternary aliphatic amines also can be utilized in the plating baths of the invention. In general, the brightening agents will be incorporated into the bath in amounts ranging from about 0.005 to about 5 grams per liter of bath.

The following examples illustrate the aqueous alkaline zinc plating baths of the invention and the utility of these plating baths as determined in a standard Hull cell.

Example A (Low Cyanide)

The bath of this example is prepared

| | |
|---|---|
| Zinc metal as sodium zincate | 7.5 g/liter |
| Sodium hydroxide | 75.0 g/liter |
| Sodium cyanide | 7.5 g/liter |
| Reaction product of Example 1 | 2 cc/liter |
| Veratraldehyde bisulfite (2% solution) | 4 cc/liter |

A plating test was conducted in a 267 ml. Hull cell at an operating current of 3 amperes for five minutes at room temperature. The zinc was deposited on a steel Hull cell panel. Bright zinc was deposited across the panel from below 1.5 a.s.f. to above 120 a.s.f. as measured with a Hull cell scale.

Example B (No Cyanide)

| | |
|---|---|
| Zinc metal as sodium zincate | 7.5 g/liter |
| Sodium hydroxide | 75.0 g/liter |
| Reaction product of Example 2 | 2 ml/liter |

The plating test was run as described in Example A and bright zinc was deposited across the panel from 3 a.s.f. to above 120 a.s.f. as measured with the Hull cell scale.

Example C (No Cyanide)

| | |
|---|---|
| Zinc metal as sodium zincate | 7.5 g/liter |
| Sodium hydroxide | 75.0 g/liter |
| Reaction product of Example 3 | 3.75 ml/liter |

The plating test was run as described in Example A and the resulting zinc deposit was bright from 3 a.s.f. to above 120 a.s.f.

Example D (No Cyanide)

| | |
|---|---|
| Zinc metal as sodium zincate | 7.5 g/liter |
| Sodium hydroxide | 75.0 g/liter |
| Reaction product of Example 4 | 3.75 ml/liter |

The plating test was conducted on this bath as described in Example A and the resulting zinc deposit was bright from 1.5 a.s.f. to above 120 a.s.f. as measured with the Hull cell scale.

Example E (No Cyanide)

| | |
|---|---|
| Zinc metal as sodium zincate | 7.5 g/liter |
| Sodium hydroxide | 75.0 g/liter |
| Reaction product of Example 5 | 3.75 ml/liter |

This bath was subjected to a plating test as described in Example A, and the resulting zinc deposit was bright from 1.5 a.s.f. to 90 a.s.f. as measured with a Hull cell scale.

Example F (No Cyanide)

| | |
|---|---|
| Zinc metal as sodium zincate | 7.5 g/liter |
| Sodium hydroxide | 75.0 g/liter |
| The reaction product of Example 6 | 2 cc/liter |

A plating test was run as described in Example A, and the resulting zinc deposit was bright from 3 a.s.f. to above 120 a.s.f. as measured with a Hull cell scale.

The embodiments of the invention in which an exclusive property or privilege is claimed are defined as follows:

1. A composition comprising the reaction product obtained by the process of (a) preparing an intermediate product by reacting formaldahyde with a mixture of i. one or more piperazines having the formula

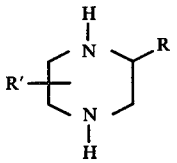

wherein R and R′ are each independently hydrogen or lower alkyl groups, and ii. at least one additional nitrogen-containing compound from the group consisting of ammonia or aliphatic, acyclic compounds containing at least one primary amine group, and (b) reacting said intermediate product with an epihalohydrin or glycerol halohydrin or mixtures thereof at a temperature within the range of from room temperature to the reflux temperature of the mixture, the molar ratio of the piperazine(s), additional nitrogen-containing compound, formaldehyde and epihalohydrin or glycerol halohydrin being with the range of from about 1:1:2:1 to about 1:1:4.5:1.

2. The composition of claim 1 wherein the additional nitrogen-containing compound is an aliphatic acyclic amine having at least two primary amine groups.

3. The composition of claim 1 wherein the epihalohydrin is epichlorohydrin.

4. The composition of claim 1 wherein the additional nitrogen-containing compound is ammonia, guanidine, one or more lower alkyl amines, one or more alkylene diamines or mixtures thereof.

5. An additive composition for an aqueous, alkaline, zinc electrodepositing bath obtained by the process of (a) preparing an intermediate product by reacting formaldehyde with a mixture of (i) one or more piperazines having the formula

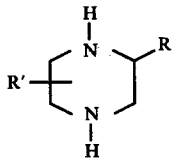

wherein R and R′ are each independently hydrogen or lower alkyl groups, (ii) at least one additional nitrogen-containing compound from the group consisting of ammonia or aliphatic, acyclic compounds containing at least one primary amine group, and (b) reacting said intermediate product with an epihalohydrin at a temperature within the range of from room temperature to the reflux temperature of the mixture, the molar ratio of the piperazine(s), additional nitrogen-containing compound, formaldehyde and epihalohydrin being within the range of from about 1:1:2:1 to about 1:1:4.5:1.

6. The additive composition of claim 5 wherein the piperazine is 2-methyl piperazine, and the additional nitrogen-containing compound is ammonia, guanidine, one or more lower alkyl amines, one or more alkylene diamines or mixtures thereof.

7. An additive composition for an alkaline zinc electrodepositing bath obtained by the process of preparing an intermediate product by reacting formaldehyde in water with a mixture of one or more piperazines and at least one aliphatic acyclic compound containing at least one primary amine group, and thereafter reacting said intermediate product with epichlorohydrin, the molar ratio of the piperazine, aliphatic compound, formaldehyde, and epichlorohydrin being within the range of from about 1:1:2:1 to about 1:1:4.5:1.

8. An additive composition for an alkaline zinc electrodepositing bath prepared by the process of preparing an intermediate product by reacting piperazine, ammonia, and formaldehyde in water and thereafter reacting said intermediate product with epichlorohydrin, the molar ratio of the piperazine, ammonia, formaldehyde and epichlorohydrin used in the process being about 1:1:4:1.

9. An aqueous alkaline electroplating bath suitable for producing bright metallic zinc deposits comprising a source of zinc ions and an effective amount, sufficient to yield a bright zinc deposit, of a bath-soluble reaction product obtained by the process of (a) preparing an intermediate product by reacting formaldehyde with a mixture of i. one or more piperazines having the formula

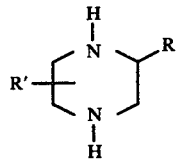

wherein R and R′ are each independently hydrogen or lower alkyl groups and ii. at least one additional nitrogen-containing compound from the group consisting of ammonia or aliphatic, compounds containing at least one primary amine group, and (b) reacting said intermediate product with an epihalohydrin or glycerol halohydrin or mixtures thereof at a temperature within the range of from room temperature to the reflux temperature of the mixture, the molar ratio of the piperazine(s), additional nitrogen-containing compound, formaldehyde and epihalohydrin or glycerol halohydrin being with the range of from about 1:1:2:1 to about 1:1:4.5:1.

10. The bath of claim 9 wherein the additional nitrogen-containing compound is an aliphatic acyclic compound having at least two primary amine groups.

11. The bath of claim 9 wherein the epihalohydrin is epichlorohydrin.

12. The bath of claim 9 wherein the additional nitrogen-containing compound is ammonia, guanidine, one or more lower alkyl amines, one or more alkylene diamines or mixtures thereof.

13. An aqueous alkaline electroplating bath suitable for producing bright metallic zinc deposits comprising a source of zinc ions and an effective amount sufficient to yield a bright zinc deposit, of a bath-soluble reaction product obtained by the process of (a) preparing an intermediate product by reacting formaldehyde in water with a mixture of (i) one or more piperazines having the formula

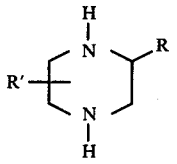

wherein R and R′ are each independently hydrogen or lower alkyl groups, (ii) at least one additional nitrogen-containing compound from the group consisting of ammonia or aliphatic, acyclic compounds containing at least one primary amine group, and (b) reacting said intermediate product with an epihalohydrin at a temperature within the range of from room temperature to the reflux temperature of the mixture, the molar ratio of the piperazine(s), additional nitrogen-containing compound, formaldehyde and epihalohydrin being within the range of from about 1:1:2:1 to about 1:1:4.5:1.

14. An aqueous alkaline electroplating bath suitable for producing bright metallic zinc deposits comprising a source of zinc ions and an effective amount, sufficient to yield a bright zinc deposit, of a bath-soluble reaction product obtained by the process of preparing an intermediate product by reacting formaldehyde in water with a mixture of one or more piperazines and an aliphatic acyclic compound containing at least one primary amine group, and thereafter reacting said intermediate product with epichlorohydrin, the molar ratio of the piperazine, aliphatic compound, formaldehyde, and epichlorohydrin used in the process being within the range of from about 1:1:2:1 to about 1:1:4.5:1.

15. An aqueous alkaline electroplating bath suitable for producing bright metallic zinc deposits comprising a source of zinc ions and an effective amount, sufficient to yield a bright zinc deposit, of a bath-soluble reaction product obtained by reacting piperazine, ammonia, and formaldehyde in water and thereafter reacting said intermediate product with epichlorohydrin, the molar ratio of the piperazine, ammonia, formaldehyde and epichlorohydrin used in the process being about 1:1:4:1.

* * * * *